United States Patent [19]

Rinke

[11] Patent Number: 4,599,835

[45] Date of Patent: Jul. 15, 1986

[54] INSERTABLE SWIMMING POOL STEP ASSEMBLY

[75] Inventor: Robert M. Rinke, Moorhead, Minn.

[73] Assignee: Adventure Enterprises, Inc., Fargo, N. Dak.

[21] Appl. No.: 798,992

[22] Filed: Nov. 18, 1985

[51] Int. Cl.[4] ..... E04F 11/00; E04H 3/16

[52] U.S. Cl. ..... 52/184; 52/169.7

[58] Field of Search ..... 52/169.7, 182–191; 4/488, 496, 506, 504

[56] References Cited

U.S. PATENT DOCUMENTS

| | | | |
|---|---|---|---|
| 2,617,764 | 11/1952 | Hauber et al. | 210/11 |
| 3,236,012 | 2/1966 | Laven | 52/184 |
| 3,374,491 | 3/1968 | Patin et al. | 4/172 |
| 3,744,198 | 7/1973 | Boassy | 52/184 |
| 3,755,981 | 9/1973 | West | 52/184 |
| 3,848,378 | 11/1974 | Witte | 52/184 |
| 3,971,076 | 7/1976 | Ahrens | 4/172.19 |
| 4,008,547 | 2/1977 | Katzman | 52/169.7 |
| 4,343,120 | 8/1982 | Witte | 52/184 |

*Primary Examiner*—J. Karl Bell

*Attorney, Agent, or Firm*—Kinney & Lange

[57] ABSTRACT

The present invention is a step assembly for insertion into swimming pools. A frame having a plurality of steps connected in an end-to-end fashion rests on the bottom of the pool and adjacent to a pool sidewall. An adjustable adapter step is connected near the top of the frame and overlaps a top rail of the pool sidewall. A ballast box is located near the bottom of the frame beneath a lower step to prevent the frame from floating in the water. A pair of hand rails are provided which extend above the steps on both sides of the frame to allow ease of entry and exit into the water. A cushioned strip is provided along the bottom and sides of the frame to guard against tears in a pool liner.

12 Claims, 5 Drawing Figures

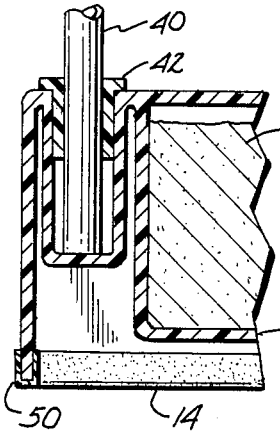
Fig.4
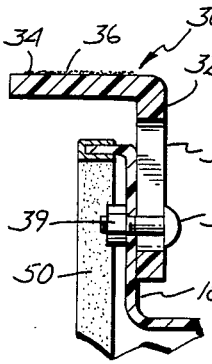
Fig.3
Fig.1
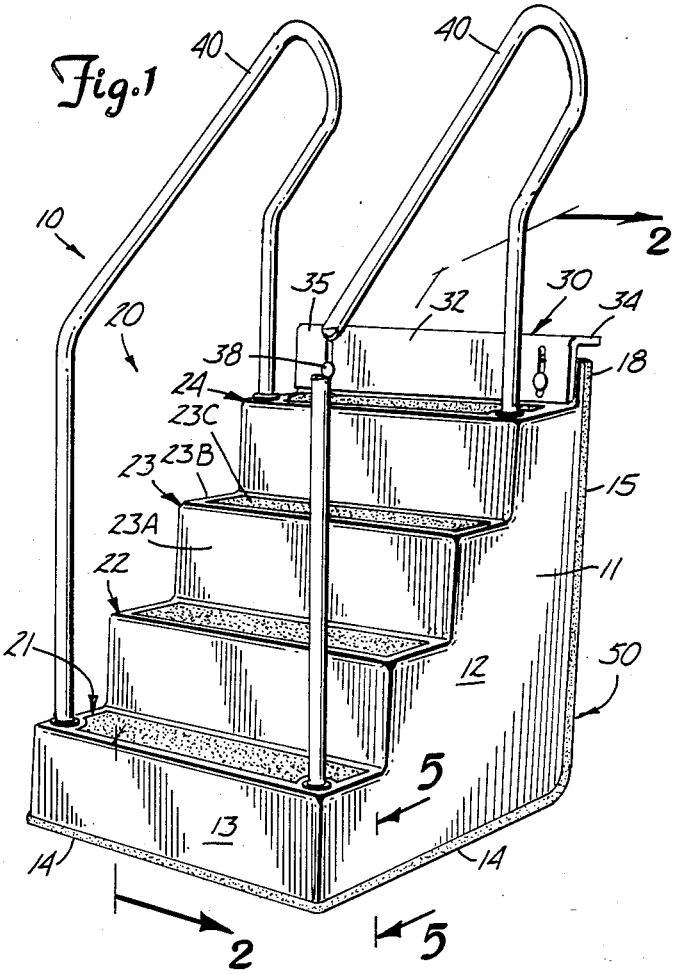
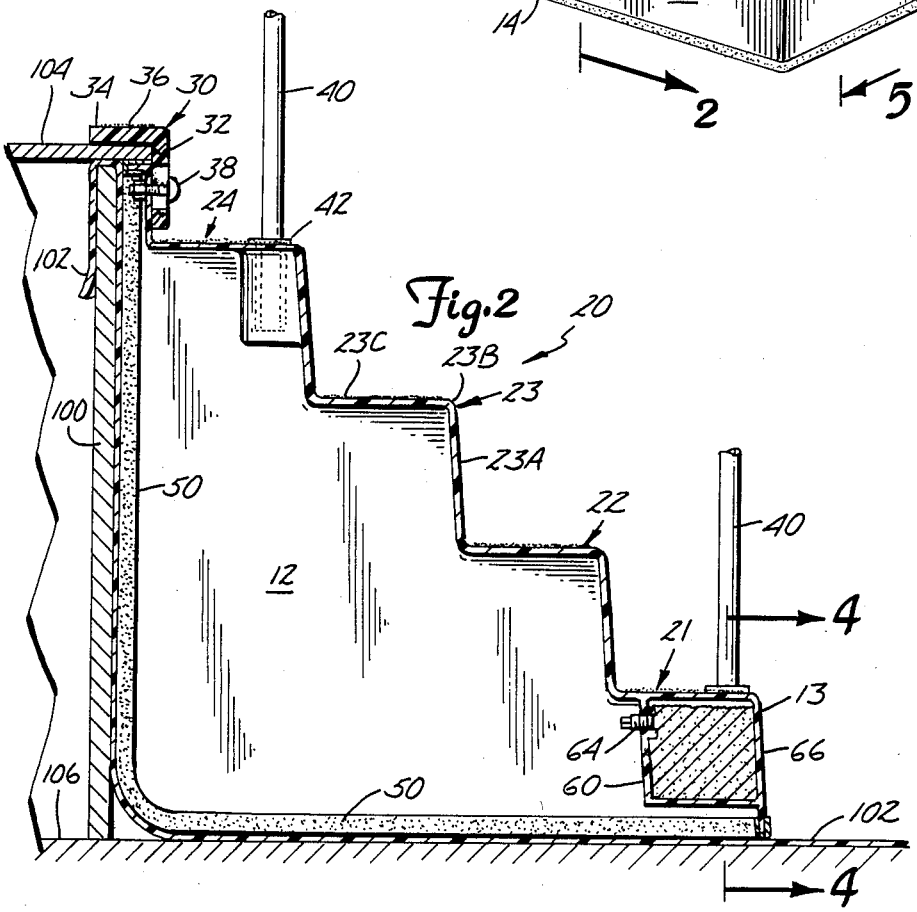
Fig.2
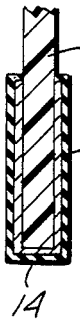
Fig.5

INSERTABLE SWIMMING POOL STEP ASSEMBLY

BACKGROUND OF THE INVENTION

1. Field of the Invention

The present invention generally relates to accessories for swimming pools, and more particularly is concerned with an insertable step assembly for above ground swimming pools.

2. Description of the Prior Art

Swimming pools provide a delightful and entertaining recreation source enjoyed by people of all ages. As the health benefits gained from swimming are recognized and appreciated, both above ground and inground swimming pools continue to grow in popularity.

Above ground pools are generally constructed from an enclosed sidewall structure which can be any desired shape. A liner for retaining water is secured from the sidewalls and covers the ground and inner area enclosed by the sidewalls. Water depth in above ground pools generally ranges between four to six feet. Oftentimes, a deck is provided around the pool or a portion thereof for use by swimmers and sunbathers.

Above ground pools are much more likely to have a ladder mounted to an inner surface of a sidewall for entrance and exit of the pool by swimmers. Such "climb-up" ladder includes several rungs secured between handrails mounted on a sidewall and extends above and below the surface of the water. Climb-up ladders for above ground swimming pools are difficult to mount securely and difficult to use, particularly for young children and the elderly. The user may easily slip and fall because of the wet surfaces.

U.S. Pat. No. 3,755,981 shows a set of swimming pool stairs that is set in an opening in the side wall of a pool. Marginal edges are set in the side wall of the pool. The steps are made of molded plastic material such as reinforced fiberglass.

U.S. Pat. No. 3,744,198 also shows a stair construction for plastic liners for pools where they use fittings that go through the liner and support the stairs. These stairs, also, are molded plastic. It is stated in column 1 of this patent that placing a stair in the pool so as to bear directly on the pool liner is not effective because the pool liner is fragile and will develop defects at the bearing points. The present invention teaches differently and has solved that problem.

U.S. Pat. No. 3,374,491 shows sunken swimming pool stairs that surround the pool, and U.S. Pat. No. 3,971,076 shows inground fiberglass pool stairs used as part of a bottom structure of the pool.

U.S. Pat. No. 4,343,120 also shows a molded structure for stairs for a swimming pool, and deals with providing a water tight seal between the sides of the stairs and the pool liner.

U.S. Pat. No. 3,326,012 shows fiberglass stairs sealed to the pool liner and extending outside of the periphery of the pool.

Conventional inground swimming pool stairs are shown in U.S. Pat. Nos. 3,848,378; 2,617,764; and 4,008,547.

None of the references cited show the assembly of unitary steps with an adjustable top step and support walls to achieve the results of the present invention.

SUMMARY OF THE INVENTION

The present invention is a self-sustaining step assembly for swimming pools. The step assembly permits swimmers to walk in and out of pools comfortably and with ease. All components of the present invention are designed to resist chemicals found in pool water and provide an economical and trouble-free means of entering a pool.

The step assembly is molded as a unit having side walls and a plurality of steps connected in an end-to-end fashion. The assembly rests on the bottom of the pool and adjacent to a pool sidewall. An adjustable adapter step is connected near the top of the frame and overlaps a top rail of the pool sidewall. A ballast box is located near the bottom of the frame beneath a lower step to prevent the frame from floating in the water. A pair of hand rails are provided which extend above the steps on both sides of the frame to allow ease of entry and exit into the water. A cushion strip is provided along the bottom and side edges of the side walls to guard against tears in a pool liner.

The side walls may be trimmed to fit irregular bottom shapes, using a suitable template to make the steps easily adaptable for various pool configurations.

BRIEF DESCRIPTION OF THE DRAWINGS

FIG. 1 is a perspective view of the insertable step assembly of the present invention.

FIG. 2 is a sectional view taken through line 2—2 of FIG. 1 showing the step assembly mounted against a pool sidewall.

FIG. 3 is an enlarged fragmentary view taken from FIG. 2 showing the top adapter step mounted on a riser of the step assembly.

FIG. 4 is an enlarged sectional view taken along line 4—4 of FIG. 2.

FIG. 5 is an enlarged sectional view taken along 5—5 of FIG. 1.

DETAILED DESCRIPTION OF THE PREFERRED EMBODIMENTS

An insertable step assembly 10 of the present invention is shown in the perspective view of FIG. 1. The step assembly 10 consists of a frame 11 having a pair of side walls 12,12 and a front wall 13. A flight 20 of steps are molded in a known manner and are integrally supported on and extend between the side walls 12,12. For purposes of illustration only, the step assembly 10 of FIG. 1 shows four steps 21, 22, 23 and 24. It is understood that any desired number of steps may be used with the present invention. It is preferred that the number of steps be selected so that the top step 24 is near and slightly above the surface of the water.

Each sidewall 12 includes a base edge 14 and a side edge 15. As can be seen best in FIG. 2, the side edge 15 of the sidewall 12 is adjacent to the inner surface of the pool sidewall 100 when step assembly 10 is inserted into the pool.

A pool liner 102 covers the ground 106 enclosed within the pool sidewall 100 and is secured over the pool sidewall 100. Typically, a top rail 104 provides a flat top surface and is secured to the pool sidewall 100. The pool construction is shown only schematically, and can be any desired construction.

The front wall 13 of the step is connected between the sidewalls 12,12. A base edge 14 of the front wall 13 rests on the pool liner 102 when the step assembly 10 is inserted into the pool.

First step 21 is provided at the bottom of the flight 20. The front wall 13 provides a riser for the first step 21. The second step 22, third step 23 and fourth step 24 each have a riser and tread. For illustration purposes, in FIGS. 1 and 2, the riser 23A and tread 23B of the third step 23 are indicated. A non-skid mat 23C is provided on the tread 23B to prevent slipping or skidding. It is preferred that each step of the flight 20 be of the same height and horizontal run.

A mounting riser or wall 18 extends perpendicular to the tread of the top step 24 and spans the width of the top step. The wall 18 also is integrally molded with the other portion of the step assembly. A non-skid mat is provided on the tread portion of each step. An adapter step 30 is provided to fit over the top rail 104 of the pool. The adapter step 30 includes a riser 32 and a tread 34. A pair of vertically oriented elongated slots 35,35 is provided in the riser 32 of the adapter step 30. After the step frame 11 is positioned adjacent to a pool sidewall 100, the adapter step 30 is installed on the mounting wall 18 so that the tread 34 extends horizontally above and rests on the top rail or casing 104 of the pool. A pair of bolts 38,38 are passed through the respective slots 35,35 and respective openings in the wall 18. The bolts 38,38 are secured in place by respective nuts 39,39 as can best be seen in FIG. 3. The slots 35,35 permit vertical adjustment of the adapter step 30 to adjust to fit individual pools. A non-skid mat 36 is provided on the tread 34 to prevent slipping or skidding. If desired, anchor bolts (not shown) may be used to further secure the adapter step 30 to the top rail 104 of the pool.

A pair of handrails 40,40 extend upwardly from the step assembly 10. Each handrail 40 is mounted on the bottom step 21 and top step 24 of the step assembly 10. When the step assembly 10 is inserted into a pool, the handrails are of sufficient height so that at least the upper portions of the handrails extend above the surface of the water. As shown in FIG. 4, the end portion of a handrail 40 fits into a molded cup 44 formed in the frame 11. The handrail 40 is placed inside an adapter sleeve 42 to secure the handrail in place. The sleeve 42 may be made of rubber or fiberglass and provides a friction fit to prevent the handrail 40 from becoming loose in the cup 44.

A liner molding or edge protector 50 is provided around the base edges 14 and side edges 15 of the walls of frame 11. As shown in the detailed view of FIG. 5, the liner molding 50 includes an aluminum strip 52 coated with a layer 54 of a suitable elastomer. The coated liner molding 50 has a smooth surface to prevent tears and other damage by roughness of the edges 14 and 15 of the frame 11 which engage the pool liner 102.

A ballast box 60 is provided inside the frame 11 between the side walls 12,12 and underneath the tread of the first step 21. The ballast box 60 includes a ballast chamber 62 which may hold a suitable ballast material 66, such as sand or pea gravel, to prevent any tendancy of the step assembly 10 to float or drift. A plug 64 in the box 60 seals the ballast chamber from the water.

In order to fit the steps into an existing pool, the edge portions, including the lower edges 14, and the vertical edges 15 of side walls 12,12, and the lower edge of front wall 13 can be trimmed to fit the bottom and side wall configurations of a pool. In order to do this, a soft piece of metal, such as soft aluminum can be formed to the shape of the pool liner for the bottom and vertical side walls. The template made can be sized to cut the edges that rest on the pool liner to the proper shape. While the illustration in FIG. 2 shows the edges to be fairly straight, in practice, the liner may not be on even ground, and there may be depressions and irregularities that can be accommodated by forming a suitable template and then laying it over the sidewall surfaces and trimming the edges of walls 12 and 13 to conform to the pool configuration.

The edge protector moldings 50 can then be slipped onto the edges of the walls after they have been trimmed, to insure that no rough edges or projecting pieces of fiberglass will tend to tear the pool liner.

It is preferred that the frame 11 be constructed from a strong, lightweight and chemically-resistant moldable material such as fiberglass reenforced materials. Use of moldable fiberglass permits a single-piece construction of the sidewalls 12,12, front wall 13, flight 20 of steps and ballast box 60. Furthermore, the lower edges 14 and vertical edges 15 of the side walls, and the lower edge of front wall 13 may be trimmed for custom fitting of the frame 11 to a desired pool.

Although the present invention has been described with reference to preferred embodiments, workers skilled in the art will recognize that changes may be made in form and detail without departing from the spirit and scope of the invention.

What is claimed is:

1. An insertable step assembly for a swimming pool comprising:

(a) a frame comprising a unitary assembly of a plurality of steps connected in an end-to-end fashion, terminating at a top end and having bottom edges for supporting the frame on a bottom surface of a swimming pool;

(b) vertically adjustable step means mounted on the top end of the frame and having a horizontal tread that extends over the top edge of a swimming pool in which the frame is placed, and means for adjustably securing the step means to the frame;

(c) means for providing ballast secured to the bottom step of the frame; and (d) a pair of handrails, one of each secured to each side of the frame.

2. The insertable step assembly of claim 1 and molding means mounted on the edges of the frame which engage the bottom and side surfaces of the swimming pool said molding means having an outer covering to prevent tears in a swimming pool liner.

3. The insertable step assembly as specified in claim 1 wherein the adjustable step means comprises:

(a) an adapter step having a tread and a riser, the riser having a plurality of vertically-oriented elongated slots; and (b) a mounting wall extending substantially perpendicularly from the tread of a top step of the frame, the means for securing comprising fastener means for securing the adapter step to the mounting wall;

whereby the adapter step is mounted on the mounting wall at a desired location by the fastener means so that the tread of the adapter step extends horizontally over a top rail of a sidewall of a swimming pool in which the step assembly is used.

4. The insertable step assembly as specified in claim 1 wherein the means for mounting the ballast comprises a closed chamber integrally formed with the frame and attached to the underside of the bottom step, and a closable opening for filling a suitable ballast material into the chamber.

5. The insertable step assembly as specified in claim 2 wherein the molding means comprises a strip having an elastomeric outer layer.

6. The insertable step assembly as specified in claim 1 wherein the frame comprises a pair of sidewalls and a front wall, the sidewalls being positioned along each side of the steps and the front wall providing a riser for the bottom step.

7. The insertable step assembly as specified in claim 1 wherein the tread of each step includes a skid-resistant surface.

8. The insertable step assembly as specified in claim 5 wherein the frame is made from molded fiberglass reinforced material.

9. A swimming pool step insert comprising:

(a) a frame having a base for engaging the bottom of a swimming pool and a pair of support walls for engaging a sidewall of such swimming pool, and a flight of steps extending from the bottom to a point near a top rail of such pool sidewall, the frame having a mounting wall extending substantially perpendicularly from a top step of the flight of steps and parallel to the sidewall of such pool and terminating at a point below the top rail of such sidewall;

(b) an adapter step means connected to the mounting wall and extending horizontally above a top rail of such swimming pool sidewall;

(c) ballast means mounted to the underside of the frame;

(d) edge lining means mounted on the edges of the frame which engage the sidewall and bottom of such swimming pool; and (e) a pair of hand rails, one mounted to and extending above each side of the frame, respectively.

10. The insertable step assembly as specified in claim 9 wherein the adapter step means comprises a removable step having a riser and a thread, the riser having a pair of vertically-oriented slots, and fastener means passing through the slots to secure the removable step to the mounting wall.

11. The insertable step assembly as specified in claim 9 wherein the ballast means comprises a closed box having a sealed chamber, and a filling of ballast material therein.

12. The insertable step assembly as specified in claim 9 wherein the edge lining means comprises an elastomeric coated aluminum strip.

* * * * *